US005946942A

United States Patent [19]

Wong et al.

[11] Patent Number: 5,946,942

[45] Date of Patent: Sep. 7, 1999

[54] ANNULAR COLUMN FOR CRYOGENIC RECTIFICATION

[75] Inventors: Kenneth Kai Wong, Amherst; John Frederic Billingham, Getzville; Dante Patrick Bonaquist; Bayram Arman, both of Grand Island; Raymond Francis Drnevich, Clarence Center; Minish Mahendra Shah, East Amherst; Todd Alan Skare, Elma, all of N.Y.

[73] Assignee: Praxair Technology, Inc., Danbury, Conn.

[21] Appl. No.: 09/129,240

[22] Filed: Aug. 5, 1998

[51] Int. Cl.[6] ..... F25J 3/04

[52] U.S. Cl. ..... 62/643; 62/905; 62/924

[58] Field of Search ..... 62/643, 903, 905, 62/900, 924

[56] References Cited

U.S. PATENT DOCUMENTS

| | | | |
|---|---|---|---|
| 1,970,299 | 8/1934 | Frankl | 62/905 X |
| 2,070,100 | 2/1937 | Twomey | 62/905 X |
| 2,281,906 | 5/1942 | Adams | 62/905 X |
| 2,760,351 | 8/1956 | Schilling | 62/905 X |
| 3,298,673 | 1/1967 | Muto et al. | 62/905 X |
| 5,282,365 | 2/1994 | Victor et al. | 62/905 X |
| 5,339,648 | 8/1994 | Lockett et al. . | |
| 5,410,885 | 5/1995 | Smolarek et al. . | |
| 5,440,884 | 8/1995 | Bonaquist et al. . | |
| 5,546,767 | 8/1996 | Dray et al. . | |
| 5,628,207 | 5/1997 | Howard et al. | 62/646 |
| 5,669,236 | 9/1997 | Billingham et al. | 62/643 |

*Primary Examiner*—Christopher B. Kilner
*Attorney, Agent, or Firm*—Stanley Ktorides

[57] ABSTRACT

An annular column, particularly useful for cryogenic rectification, comprising coaxially oriented, radially spaced cylindrical column walls defining a first column region, and a second column region between the walls, wherein different fluid mixtures are rectified in each of the first column and second column regions.

6 Claims, 4 Drawing Sheets

ANNULAR COLUMN FOR CRYOGENIC RECTIFICATION

TECHNICAL FIELD

This invention relates generally to rectification and is particularly useful for cryogenic rectification such as the cryogenic rectification of feed air.

BACKGROUND ART

A major expense of a rectification plant for the separation of a fluid mixture into components based on their relative volatility is the cost of the column casing and the space required for the column. This is particularly the case where two or more columns are required to conduct the separation. Such multi-column systems are often used in cryogenic rectification, such as in the cryogenic rectification of feed air, where columns may be stacked vertically or located side by side. It would be highly desirable to have a system which will enable rectification to be carried out with reduced column cost and with reduced space requirements for the columns.

Accordingly it is an object of this invention to provide a column system for rectification which has reduced costs and space requirements over comparable conventional systems.

SUMMARY OF THE INVENTION

The above and other objects, which will become apparent to one skilled in the art upon a reading of this disclosure, are attained by the present invention, one aspect of which is:

An annular column for carrying out rectification, said column comprising:

(A) a cylindrical main column wall defining a first column region;

(B) an annular column wall radially spaced from the main column wall demarcating a second column region between the main column wall and the annular column wall;

(C) means for passing fluid into the first column region and means for withdrawing fluid from the first column region; and (D) means for passing fluid into the second column region and means for withdrawing fluid from the second column region.

Another aspect of the invention is:

Apparatus for carrying out cryogenic rectification of feed air comprising:

(A) a higher pressure column and an annular column, said annular column comprising a cylindrical main column wall defining a first column region and an annular column wall radially spaced from the main column wall demarcating a second column region between the main column wall and the annular column wall;

(B) means for passing feed air into the higher pressure column, means for passing fluid from the higher pressure column into the first column region, and means for passing fluid from the first column region into the second column region;

(C) means for recovering at least one of product nitrogen and product oxygen from the first column region; and (D) means for recovering product argon from the second column region.

Yet another aspect of the invention is:

Apparatus for carrying out cryogenic rectification of feed air comprising:

(A) an annular column comprising a cylindrical main column wall defining a lower pressure region, and an annular column wall radially spaced from the main column wall demarcating a higher pressure region between the main column wall and the annular column wall;

(B) means for passing feed air into the higher pressure region, and means for passing fluid from the higher pressure region into the lower pressure region; and (C) means for recovering at least one of product nitrogen and product oxygen from the lower pressure region.

A further aspect of the invention is:

Apparatus for carrying out cryogenic rectification of feed air comprising:

(A) a lower pressure column and an annular column, said annular column comprising a cylindrical main column wall defining a main column region and an annular column wall radially spaced from the main column wall demarcating a side column region between the main column wall and the annular column wall;

(B) means for passing feed air into the main column region, means for passing fluid from the main column region into the lower pressure column, and means for passing fluid from the lower pressure column into the side column region; and (C) means for recovering product oxygen from the side column region.

As used herein the term "product oxygen" means a fluid having an oxygen concentration greater than 80 mole percent, preferably greater than 95 mole percent.

As used herein the term "product nitrogen" means a fluid having a nitrogen concentration greater than 95 mole percent, preferably greater than 99 mole percent.

As used herein the term "product argon" means a fluid having an argon concentration greater than 80 mole percent, preferably greater than 95 mole percent.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "feed air" means a mixture comprising primarily oxygen, nitrogen and argon such as ambient air.

As used herein the term "reboiler" means a heat exchange device that generates column upflow vapor from column liquid.

As used herein the term "condenser" means a heat exchange device that generates column downflow liquid from column vapor.

Figure 1:
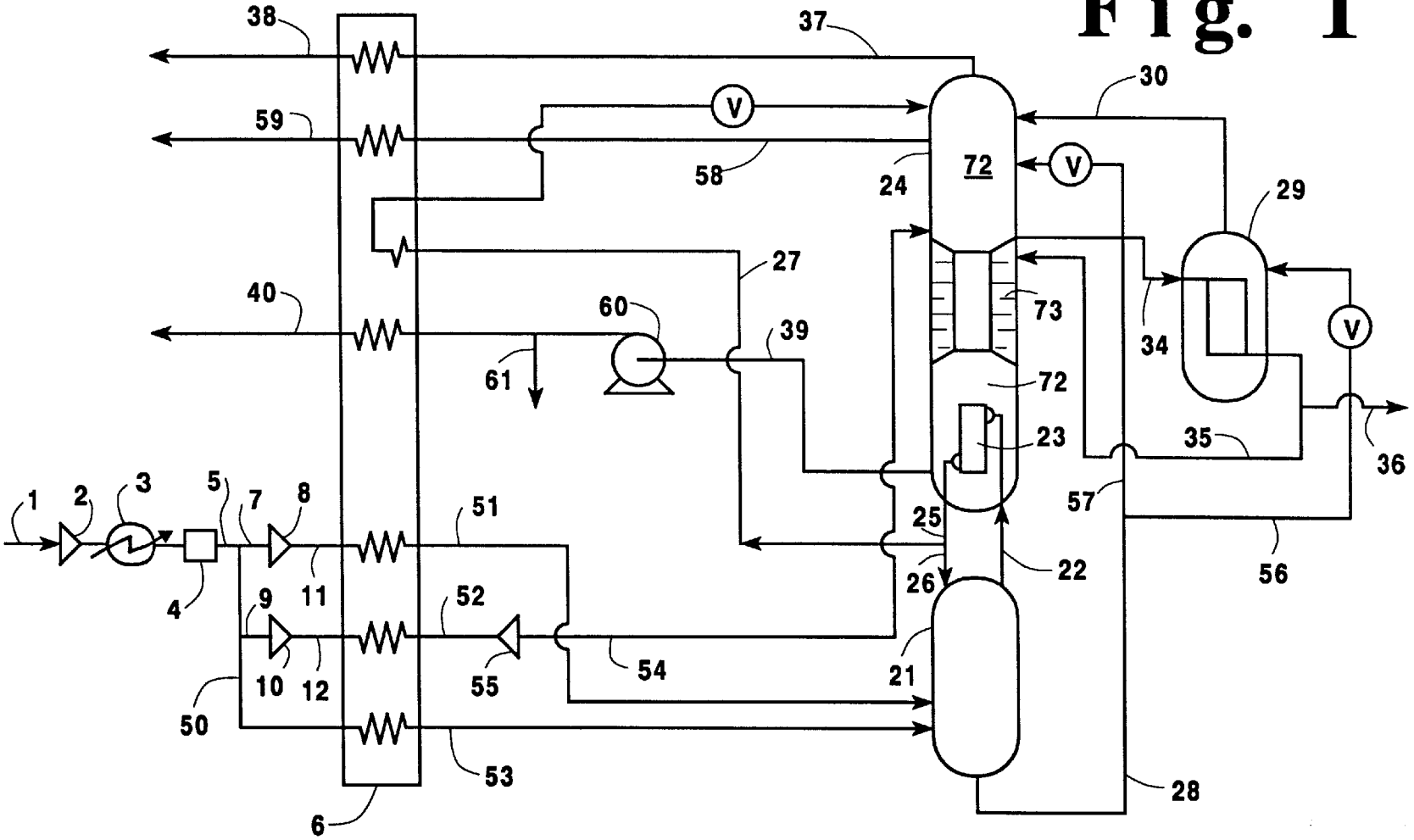
FIG. 1 is a schematic representation of one preferred embodiment of the invention wherein the annular column is used in a cryogenic rectification system which produces argon.

The numerals in the Drawings are the same for the common elements.

DETAILED DESCRIPTION

Figure 2:
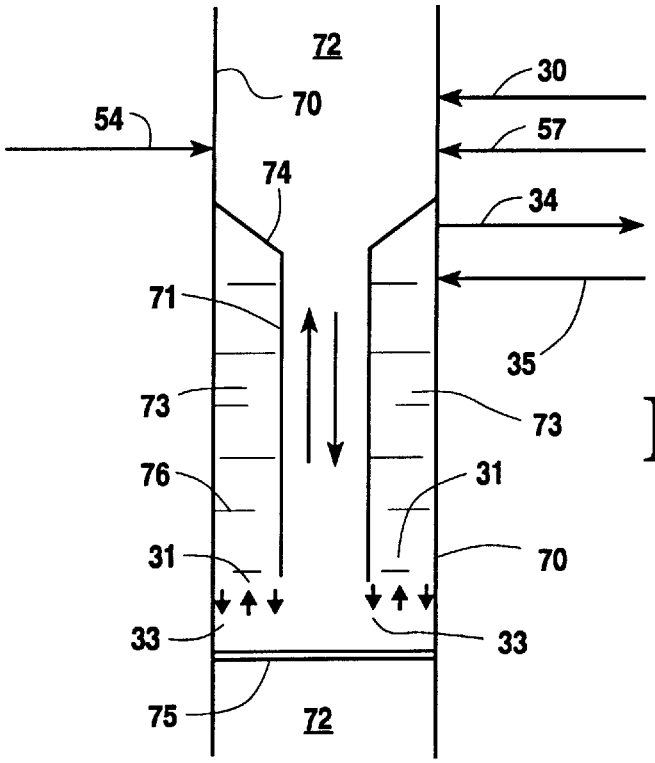
FIG. 2 is a more detailed view of the embodiment illustrated in FIG. 1.

The invention will be described in detail with reference to the Drawings. FIGS. 1 and 2 illustrate one embodiment of a cryogenic rectification system wherein the annular column of the invention may be employed.

Referring now to FIGS. 1 and 2, feed air 1 is compressed in compressor 2 and cooled of the heat of compression by passage through cooler 3. The pressurized feed air is then cleaned of high boiling impurities such as water vapor, carbon dioxide and hydrocarbons by passage through purifier 4 which is typically a temperature or a pressure swing adsorption purifier. Cleaned, compressed feed air 5 is then cooled by indirect heat exchange with return streams in primary heat exchanger 6. In the embodiment illustrated in FIG. 1, a first portion 7 of feed air 5 is further compressed by passage through booster compressor 8, a second portion 9 is further compressed by passage through booster compressor 10, and resulting further compressed feed air portions 11 and 12 and remaining compressed feed air portion 50 are cooled by passage through primary heat exchanger 6 to produce compressed, cleaned and cooled feed air, in streams 51, 52, and 53 respectively. Stream 52 is turboexpanded to form stream 54 by passage through turboexpander 55 to generate refrigeration for the subsequent cryogenic rectification and then passed into annular column 24. Streams 51 and 53 are each passed into higher pressure column 21.

Within higher pressure column 21 the feed air is separated by cryogenic rectification into nitrogen-enriched vapor and oxygen-enriched liquid. Nitrogen-enriched vapor is passed in stream 22 into reboiler 23 wherein it is condensed by indirect heat exchange with annular column 24 bottom liquid to form nitrogen-enriched liquid 25. A portion 26 of nitrogen-enriched liquid 25 is returned to higher pressure column 21 as reflux, and another portion 27 of nitrogen-enriched liquid 25 is subcooled in heat exchanger 6 and then passed into annular column 24 as reflux. Oxygen-enriched liquid is passed from the lower portion of higher pressure column 21 in stream 28 and a portion 56 is passed into argon condenser 29 wherein it is vaporized by indirect heat exchange with argon-richer vapor, and the resulting oxygen-enriched fluid is passed as illustrated by stream 30 from condenser 29 into annular column 24. Another portion 57 of the oxygen-enriched liquid is passed directly into annular column 24.

Annular column 24 comprises a cylindrical main column wall 70 and a cylindrical annular column wall 71 radially spaced from the main column wall. Concentric cylindrical walls 70 and 71 define a first column region 72 and a second column region 73. Second column region 73 is the volume between the main column wall and the annular column wall and first column region 72 comprises at least some of the volume enclosed by the main column wall but not part of second column region 73. Second column region 73 is closed off from first column region 72 at the upper end of second column region 73 by separator 74, and is in flow communication at lower end of second column region 73 with first column region 72 through distributor 75. Preferably, as illustrated in FIGS. 1 and 2, the vapor/liquid contacting internals in second column region 73 are annular trays 76. The vapor/liquid contacting internals in first column region 72 preferably comprise packing.

Vapor comprising mostly oxygen and argon passes from first column region 72 through distributor 75 into second column region 73 wherein it is separated by cryogenic rectification with downflowing liquid into argon-richer vapor and oxygen-richer liquid. The oxygen-richer liquid is returned to first column region 72 through distributor 75 as shown by flow arrows 33. The argon-richer vapor is passed in stream 34 into condenser 29 wherein it condenses by indirect heat exchange with the vaporizing oxygen-enriched liquid as was previously described. Resulting argon-richer liquid is returned in stream 35 to second column region 73 to be the aforesaid downflowing liquid. A portion 36 of the argon-richer liquid may be recovered as product argon indirectly from second column region 73. Alternatively, or in addition to stream 36, a portion of the argon-richer vapor may be recovered directly from second column region 73 as product argon.

Annular column 24 is operating at a pressure less than that of higher pressure column 21. Within first column region 72 of annular column 24 the various feeds into the first column region are separated by countercurrent cryogenic rectification into nitrogen-rich fluid and oxygen-rich fluid. Nitrogen-rich fluid is withdrawn from the upper portion of annular column 24 as vapor stream 37, warmed by passage through primary heat exchanger 6 and recovered as product nitrogen 38. A waste stream 58 is withdrawn from the upper portion of annular column 24, warmed by passed through heat exchanger 6 and removed from the system in stream 59. Oxygen-rich fluid is withdrawn from the lower portion of annular column 24 as vapor and/or liquid. If withdrawn as a liquid, the oxygen-rich liquid may be pumped to a higher pressure and vaporized either in a separate product boiler or in primary heat exchanger 6 prior to recovery as high pressure product oxygen. In the embodiment illustrated in FIG. 1 oxygen-rich fluid is withdrawn from annular column 24 as liquid stream 39, pumped to a higher pressure through liquid pump 60, vaporized by passage through primary heat exchanger 6, and recovered as product oxygen 40. A portion 61 of the liquid oxygen may be recovered as liquid product oxygen.

The annular column used in the system described in conjunction with FIGS. 1 and 2 takes the place of the lower pressure column and the argon sidearm column of a conventional cryogenic air separation plant. In the embodiment of the invention illustrated in FIG. 3 the annular column takes the place of higher pressure and lower pressure columns of a conventional cryogenic air separation plant. The embodiment of the invention illustrated in FIG. 3 also includes an annular arrangement similar to that described in conjunction with FIGS. 1 and 2 for the production of product argon. It is understood, however, that such product argon capability is not necessary or can be provided by use of a conventional argon sidearm column when practicing the embodiment of the invention illustrated in FIG. 3. Those aspects of the system illustrated in FIG. 3 which are the same as previously discussed in connection with the system illustrated in FIGS. 1 and 2 are given common numerals and will not again be discussed in detail.

Figure 3:
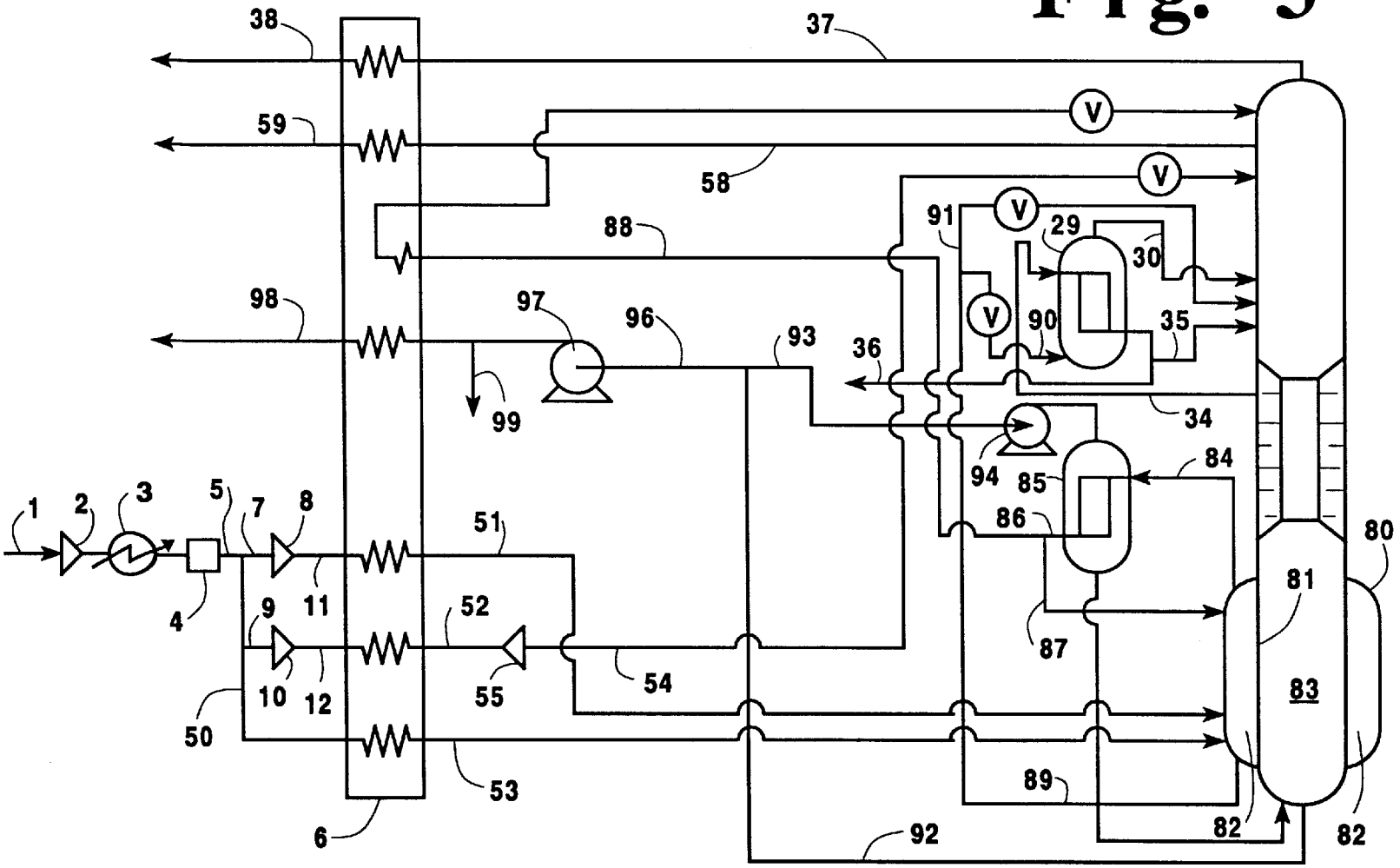
FIG. 3 is a schematic representation of another preferred embodiment of the invention wherein the annular column is used in a double column type cryogenic rectification system.

The subject annular column illustrated in FIG. 3 differs from that illustrated in FIGS. 1 and 2 in that the annular column wall 80 is outside of the cylindrical volume defined by main column wall 81 and the second column region 82 is at a higher pressure than is first column region 83, whereas in the embodiment illustrated in FIGS. 1 and 2 the annular column wall is within the volume defined by the main column wall and, in addition, the pressure in the second column region is about the same as that in the first column region.

Referring now to FIG. 3, feed air streams 51 and 53 are passed into second column region or higher pressure region 82 and within higher pressure region 82 the feed air is separated by cryogenic rectification into nitrogen-enriched vapor and oxygen-enriched liquid. Nitrogen-enriched vapor is passed in stream 84 into reboiler 85 wherein it is condensed by indirect heat exchange with bottom liquid from first column region or lower pressure region 83 to form nitrogen-enriched liquid 86. A portion 87 of nitrogen-enriched liquid 86 is returned to higher pressure region 82 as reflux, and another portion 88 of nitrogen-enriched liquid 86 is subcooled in heat exchanger 6 and then passed into the upper portion of lower pressure region 83 as reflux. Oxygen-enriched liquid is passed from high pressure region 82 in stream 89 and a portion 90 is passed into condenser 29 wherein it is vaporized by indirect heat exchange with argon-richer vapor, and the resulting oxygen-enriched fluid is passed in stream 30 from condenser 29 into lower pressure region 83. Another portion 91 of the oxygen-enriched liquid is passed directly into lower pressure region 83.

Within lower pressure region 83 the various feeds are separated by countercurrent cryogenic rectification into nitrogen-rich fluid and oxygen-rich fluid. oxygen-rich fluid, in the embodiment illustrated in FIG. 3, is withdrawn from the lower portion of lower pressure region 83 in stream 92. A portion 93 of stream 92 is passed into liquid pump 94 and from there into reboiler 85 wherein it is vaporized by indirect heat exchange with condensing nitrogen-enriched vapor as was previously described. Resulting oxygen-rich vapor is then passed into the lower portion of lower pressure region 83 from reboiler 85 in stream 95. Another portion 96 of stream 92 is pumped to a higher pressure through liquid pump 97, vaporized by passage through primary heat exchanger 6, and recovered as product oxygen 98. A portion 99 of the liquid oxygen may be recovered as liquid product oxygen.

Figure 5:
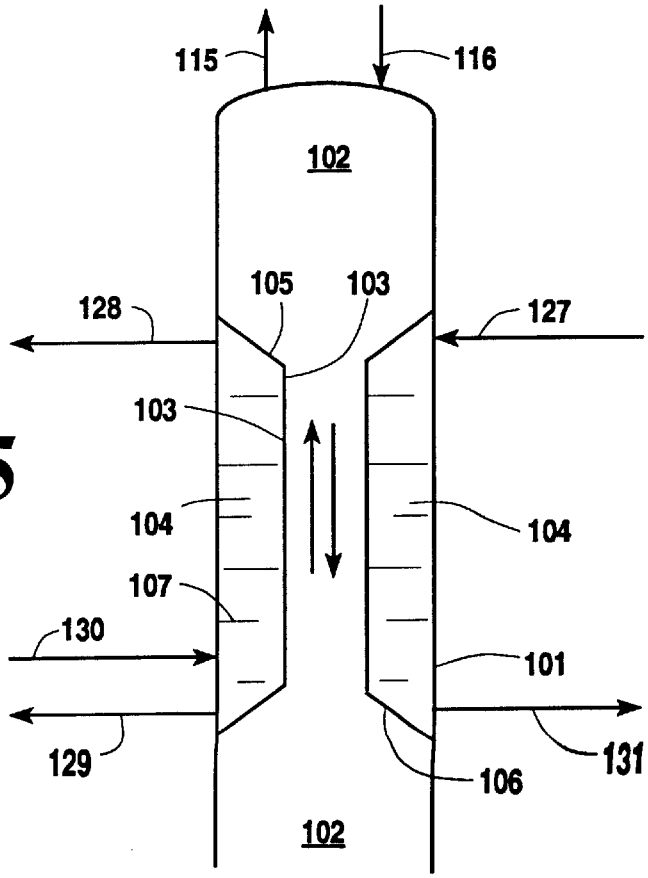
FIG. 5 is a more detailed view of the embodiment illustrated in FIG. 4.
Figure 4:
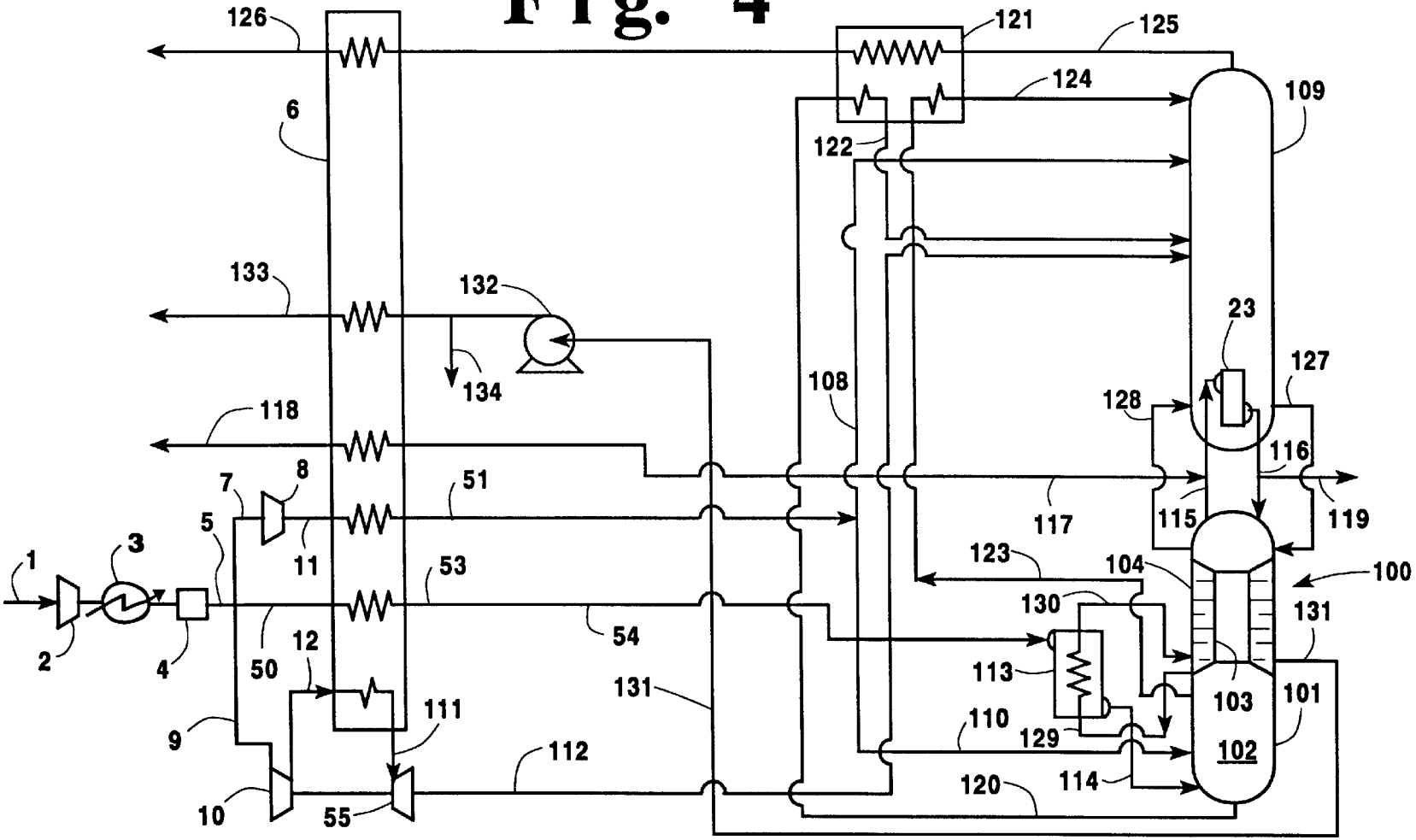
FIG. 4 is a schematic representation of another preferred embodiment of the invention wherein the annular column is used in a side column type cryogenic rectification system.

In the embodiment of the invention illustrated in FIGS. 4 and 5 the annular column is employed in place of a side column and a higher pressure column of a conventional cryogenic air separation plant.

Referring now to FIGS. 4 and 5 annular column 100 has cylindrical main column wall 101 defining first column region or main column region 102 and annular column wall 103, radially spaced from main column wall 101, demarcating second column region or side column region 104 between main column wall 101 and annular column wall 103. Annular column wall 103 is within the cylindrical volume defined by main column wall 101 and side column region 104 is at a lower pressure than is main column region 102. Side column region 104 is separated from main column region 102 at the top of side column region 104 by separator 105 and at the bottom of side column region 104 by separator 106. Side column region 104 preferably contains annular trays as the mass transfer internals.

Feed air stream 51 is divided into stream 108, which is passed into lower pressure column 109, and into stream 110 which is passed into main column region 102. Feed air stream 12 undergoes partial traverse of main heat exchanger 6 and resulting stream 111 is turboexpanded by passage through turboexpander 55 which, in the embodiment illustrated in FIG. 4, is directly coupled to and serves to drive compressor 10. Resulting turboexpanded feed air stream 112 is then passed from turboexpander 55 into lower pressure column 109.

Feed air stream 53 is passed into heat exchanger 113 wherein it is at least partially condensed and passed in stream 114 into main column region 102. Within main column region 102 the feed air is separated by cryogenic rectification into nitrogen-enriched vapor and oxygen-enriched liquid. Nitrogen-enriched vapor is passed in stream 115 into reboiler 23 wherein it is condensed by indirect heat exchange with lower pressure column 109 bottom liquid to form nitrogen-enriched liquid 116. If desired, as illustrated in FIG. 4, a portion 117 of nitrogen-enriched vapor 115 may be passed through main heat exchanger 6 and recovered as high pressure product nitrogen vapor.

Nitrogen-enriched liquid 116 is passed into main column region 102 as reflux. If desired, a portion 119 of nitrogen-enriched liquid 116 may be recovered as higher pressure product nitrogen liquid. Oxygen-enriched liquid is withdrawn from the lower portion of main column region 102 in stream 120, subcooled by passage through subcooler 121, and the resulting subcooled oxygen-enriched liquid is passed as illustrated by stream 122 into lower pressure column 109. A liquid stream 123 taken from main column region 102 and comprising nitrogen and oxygen is subcooled by passage through subcooler 121 and then passed as stream 124 into the upper portion of lower pressure column 109.

Lower pressure column 109 is operating at a pressure less than that of main column region 102. Within lower pressure column 24 the various feeds into the column are separated by cryogenic rectification into nitrogen-containing fluid and oxygen-containing fluid. Nitrogen-containing fluid is withdrawn from the upper portion of lower pressure column 109 as vapor stream 125, warmed by passage through subcooler 121 and primary heat exchanger 6 and removed from the system in stream 126. Oxygen-containing fluid is withdrawn from the lower portion of lower pressure column 109 in stream 127 and passed into side column region 104 wherein it is separated by countercurrent cryogenic rectification into oxygen-richer fluid and oxygen-poorer fluid. Oxygen-poorer fluid is passed as vapor stream 128 from side column region 104 into the lower portion of lower pressure column 109. A portion of the oxygen-richer fluid is passed as liquid stream 129 from side column region 104 into heat exchanger 113 wherein it is at least partially vaporized by indirect heat exchange with aforesaid at least partially condensing feed air stream 53, and resulting oxygen-richer fluid is returned to side column region 104 from heat exchanger 113 in stream 130. Another portion of the oxygen-richer fluid is withdrawn from side column region 104 as liquid in stream 131, pumped to a higher pressure through liquid pump 132, vaporized by passage through main heat exchanger 6, and recovered as product oxygen 133. A portion 134 of liquid oxygen stream 120 may be recovered as liquid product oxygen.

Now with the use of this invention one can carry out rectification of a multicomponent mixture using less space and less material, particularly column casing material, than has heretofore been necessary to effect an equivalent separation. Although the invention has been described in detail with reference to certain preferred embodiments, those skilled in the art will recognize that there are other embodiments of the invention within the spirit and the scope of the claims. For example, although the invention was discussed in detail with reference to cryogenic rectification, such as the rectification of air, it is understood that the invention may be employed to carry out other rectification processes such as, for example, oil fractionations, hydrocarbon separations and alcohol distillations.

We claim:

1. An annular column for carrying out rectification, said column comprising:

(A) a cylindrical main column wall defining a first column region;

(B) an annular column wall radially spaced from the main column wall within an inside volume set off by the main column wall and having a separator extending from the annular column wall to the main column wall demarcating a second column region between the main column wall and the annular column wall;

(C) means for passing fluid into the first column region and means for withdrawing fluid from the first column region; and (D) means for passing fluid into the second column region and means for withdrawing fluid from the second column region.

2. The annular column of claim 1 wherein vapor/liquid contacting internals in the second column region comprise annular trays and vapor/liquid contacting internals in the first column region comprise packing.

3. Apparatus for carrying out cryogenic rectification of feed air comprising:

(A) a higher pressure column and an annular column, said annular column comprising a cylindrical main column wall defining a first column region and an annular column wall radially spaced from the main column wall demarcating a second column region between the main column wall and the annular column wall;

(B) means for passing feed air into the higher pressure column, means for passing fluid from the higher pressure column into the first column region, and means for passing fluid from the first column region into the second column region;

(C) means for recovering at least one of product nitrogen and product oxygen from the first column region; and (D) means for recovering product argon from the second column region.

4. The apparatus of claim 3 wherein vapor/liquid contacting internals in the second column region comprise annular trays and vapor/liquid contacting internals in the first column region comprise packing.

5. Apparatus for carrying out cryogenic rectification of feed air comprising:

(A) a lower pressure column and an annular column, said annular column comprising a cylindrical main column wall defining a main column region and an annular column wall radially spaced from the main column wall demarcating a side column region between the main column wall and the annular column wall;

(B) means for passing feed air into the main column region, means for passing fluid from the main column region into the lower pressure column, and means for passing fluid from the lower pressure column into the side column region; and (C) means for recovering product oxygen from the side column region.

6. The apparatus of claim 5 further comprising means for recovering product nitrogen from the main column region.

* * * * *